United States Patent [19]

Kinser

[11] 3,953,031

[45] Apr. 27, 1976

[54] YIELDABLE HORSESHOE STAKE

[76] Inventor: Vernon Kinser, Jenkins, Mo. 65677

[22] Filed: Feb. 10, 1975

[21] Appl. No.: 549,015

[52] U.S. Cl. ..... 273/104
[51] Int. Cl.[2] ..... A63B 67/00
[58] Field of Search ..... 273/95 R, 100, 102 R, 273/102 AP, 104

[56] References Cited

UNITED STATES PATENTS

| | | | |
|---|---|---|---|
| 2,204,078 | 6/1940 | Ferrary | 273/104 |
| 3,353,828 | 11/1967 | Kinser | 273/104 |
| 3,547,442 | 12/1970 | Fenicchia | 273/104 |
| 3,814,428 | 6/1974 | Foley | 273/102 R |
| 3,844,560 | 10/1974 | Litsch | 273/104 |

*Primary Examiner*—Richard C. Pinkham
*Assistant Examiner*—Marvin Siskind
*Attorney, Agent, or Firm*—Ralph W. Kalish

[57] ABSTRACT

A stake for the game of horseshoes having its target part coiled to form a curvature, and being mounted by means of a horizontally disposed extension hinged for swingable support of the stake, and a yieldable member disposed also for support of the stake.

5 Claims, 2 Drawing Figures

YIELDABLE HORSESHOE STAKE

This invention relates generally to an improvement in stakes used in the game of horseshoes.

More specifically my invention relates to an improved stake for use in the well known game of horseshoes, which, in its present form, is played by pitching or tossing horseshoes at a stake as a target some distance from the player, the object being to score by encircling the stake or by coming as close to it as possible.

Usually the stake is mounted in cantilever or springboard fashion, that is, it is rigidly supported some distance under the ground with its target part or target length extending vertically above the ground level except for leaning somewhat toward the players. A horseshoe, thus, at the end of its trajectory can collide with the stake, in every instance or equal momentum and in the same direction, but at varying distances above the ground level, and because of the cantilever mounting of the stake there can result varying deflection and recoil of the stake.

Such varying deflection and recoil of the stake is a hazard against scoring since, on the one hand, too much deflection of the stake could reduce the rebound of the horseshoe from its collision with the stake enough to allow the recoil of the stake to force the horseshoe out of scoring range while, on the other hand, too little deflection of the stake could increase the rebound of the horseshoe from its collision with the stake enough to force the horseshoe out of scoring range. Too much or too little deflection is the hazard.

My present invention has, hence, for its prime object the provision of a highly efficient stake, with a highly adapted and improved mounting and with a curvature in its target length part disposed for cooperation with the mounting in a manner to bring about uniform deflection response of the stake to collisions occurring at random along its target length part.

And with the above and other objects in view, my invention resides in the novel features of form, construction, arrangement, and combination of parts presently described and pointed out in the claims.

In the accompanying drawings (one sheet):

Figure 1:
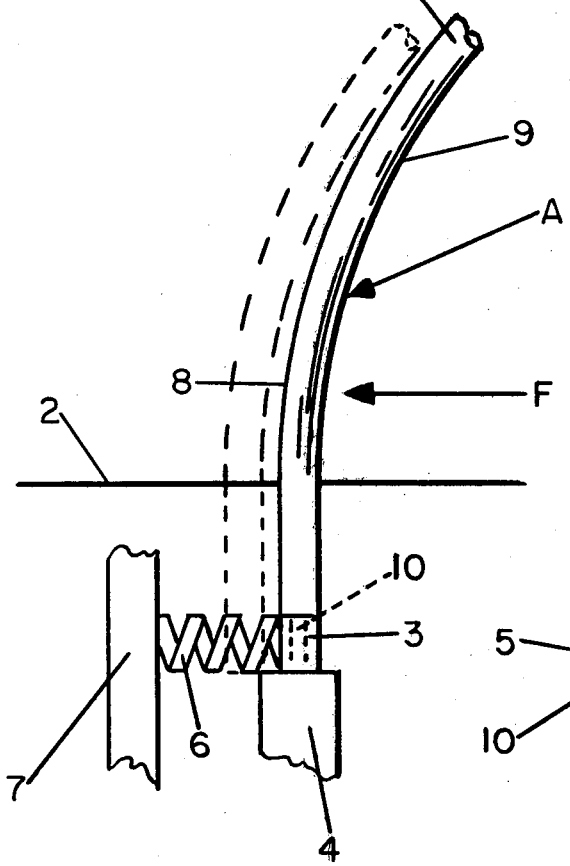
FIG. 1 is an elevated side view of one of my stakes.
Figure 2:
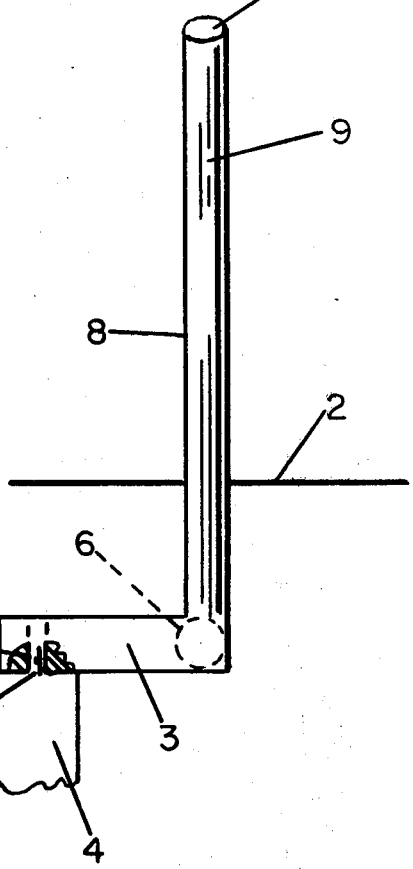
FIG. 2 is an elevated front view of one of my stakes in the direction of the arrow F FIG. 1.

Referring now more in detail and by reference characters to the drawings, which illustrate the preferred embodiment of my invention, the stake 1 is mounted or supported below the ground level 2, for which purpose it is provided with a horizontally disposed extension 3 hinged in any suitable manner for swingable support of stake 1 with respect to the stationary member 4 (fragment shown), as, by means of the trunnion 10 provided as an integral part of the stationary member 4 and the bore 5 provided as part of the extension 3.

For further support of the stake 1 below the ground level 2, the yieldable member or spring 6 is disposed between the stake 1 and the stationary member 7 (fragment shown), the spring 6 and the tunnion 10 being disposed for, as nearly as possible, only yieldable support of the stake 1 by the spring 6, and for only rotative support of stake 1 by the extension 3, against impact forces from collisions brought about in normal use, and exerted against the target part of stake 1 or target length 8.

If stake 1 could transmit forces from impact of collisions along its target-length 8 to the spring 6 with complete rigidity, stake 1 would swing on trunnion 10, and deflection of spring 6 and target-length 8 would always be equal and uniform. But complete rigidity is not possible, therefore, as the distance of the collisions from the spring 6 increases, rigidity decreases, though only a slight amount, it will be understood.

Means are provided to compensate for any lack of rigidity on the part of stake 1 to keep deflection from collisions along its target length 8 uniform, for which purpose, the target length 8 is formed to provide a curvature or radius 9, disposed so that collisions, all of the same momentum and in the same direction as the arrow A at random along the radius 9 will become more glancing as the distance from the spring 6 increases, in a manner to decrease the impact of the collisions along the target length 8 as the rigidity of stake 1 decreases.

In the use and operation it will be seen that my new stake effects its purpose. The mounting or supporting members which include the spring 6 and the trunnion 10 are disposed so as to bring about complete uniform deflection response to collisions as the same occur at random along the target length 8 of stake 1, excepting only for some lack of rigidity on the part of stake 1. Leaving it to the radius 9 to compensate for such lack of rigidity for cooperation with the supporting members to bring about complete uniform deflection response of stake 1 to collisions along its target length 8.

It will be understood that, if desired, various changes and modifications in the form, construction, arrangement and combination of the parts of my stake may be made and substituted for those herein shown and described without departing from the nature and principles of my invention.

Having thus described my invention, what I claim and desire to secure by Letters Patent is:

1. A target for missiles impelled thereagainst comprising a support base, a stake having a lower end portion received within said base and an upper, target-forming portion projecting above said base, swingable mounting means located within said base and comprising an arm having a free end engaged to the lower end portion of said stake within said support base and being in axially perpendicular relationship thereto, means hingedly engaging the stake-remote end of said arm, and resilient means engaging said stake rendering same yieldable in a direction substantially coincident with the path of travel of said missle and urging same into target position, said upper target forming portion of said stake being formed on a radius developing a concave-convex contour with the concave side presented in a direction toward the path of travel of missiles impelled against said target.

2. A target for missiles impelled thereagainst as defined in claim 1 and further characterized by said resilient means comprising a spring having one end secured to said stake, and means fixedly engaging the other end of said spring, the axis of said spring being normally perpendicular to the axis of said arm.

3. A target for missiles impelled thereagainst as defined in claim 2 and further characterized by said means fixedly engaging said spring other end being located within said support base spacedly from the side of the stake confronting missiles impelled thereagainst.

4. A target for missiles impelled thereagainst as defined in claim 1 and further characterized by said upper, target-forming portion of said stake being arcuated for extension toward the source of missiles impelled thereagainst.

5. A target for missiles impelled thereagainst as defined in claim 1 and further characterized by said means hingedly engaging the stake-remote end of said arm comprising a vertical pivot axis.

* * * * *